US010597189B2

(12) United States Patent
Gu et al.

(10) Patent No.: US 10,597,189 B2
(45) Date of Patent: Mar. 24, 2020

(54) JOINTED PACKAGE CORNER PROTECTOR

(71) Applicant: Wuhan China Star Optoelectronics Technology Co., Ltd., Wuhan (CN)

(72) Inventors: Hua Gu, Wuhan (CN); Zhongjie Liu, Wuhan (CN)

(73) Assignee: WUHAN CHINA STAR OPTOELECTRONICS TECHNOLOGY CO., LTD., Wuhan, Hubei (CN)

( * ) Notice: Subject to any disclaimer, the term of this patent is extended or adjusted under 35 U.S.C. 154(b) by 427 days.

(21) Appl. No.: 15/529,500

(22) PCT Filed: Apr. 10, 2017

(86) PCT No.: PCT/CN2017/079909
§ 371 (c)(1),
(2) Date: May 25, 2017

(87) PCT Pub. No.: WO2018/157444
PCT Pub. Date: Sep. 7, 2018

(65) Prior Publication Data

US 2018/0334282 A1 Nov. 22, 2018

(30) Foreign Application Priority Data

Mar. 3, 2017 (CN) ..... 2017 1 0124746

(51) Int. Cl.
*B65D 5/50* (2006.01)
*B65D 71/00* (2006.01)
*B65D 81/05* (2006.01)

(52) U.S. Cl.
CPC ..... *B65D 5/50* (2013.01); *B65D 71/0096* (2013.01); *B65D 81/054* (2013.01); *B65D 2571/00117* (2013.01)

(58) Field of Classification Search
CPC ..... B65D 5/50; B65D 5/2033; B65D 5/5011; B65D 1/02; B65D 65/38; B65D 81/02
(Continued)

(56) References Cited

U.S. PATENT DOCUMENTS

2011/0293398 A1 12/2011 Leibreich

FOREIGN PATENT DOCUMENTS

CN 2427469 Y 4/2001
CN 102885497 A 1/2013
(Continued)

*Primary Examiner* — Anthony D Stashick
*Assistant Examiner* — Raven Collins
(74) *Attorney, Agent, or Firm* — Leong C. Lei

(57) ABSTRACT

The present invention provides a jointed package corner protector, which includes corner plates (1) each of which is formed, in two opposite, upper and lower, ends thereof, with first through holes (11) that are perpendicular to a lengthwise direction of the corner plates (1) and a joint sheath (31) that is formed with second through holes (311) that correspond to the first through holes (11) formed in an upper end of a lower-side corner plate (1) of two corner plates (1) that are arranged adjacent to each other as being respectively set at upper and lower sides and the first through holes (11) formed in a lower end of the upper-side corner plate (1) so that button fasteners (33) may be set to penetrate through corresponding ones of the first through holes (11) and the second through holes (311) to connect the two adjacent corner plates (1) of the upper and lower sides to the joint sheath (31), whereby easy variation of a length of the package corner protector can be achieved accommodate stacked heights of different package specifications of display devices so as to be economic and practical and help improve manufacturing efficiency.

8 Claims, 7 Drawing Sheets

(58) Field of Classification Search
USPC ..... 206/586; 414/800
See application file for complete search history.

(56) References Cited

FOREIGN PATENT DOCUMENTS

| | | | |
|---|---|---|---|
| CN | 104421262 | A | 3/2015 |
| CN | 104495061 | A | 4/2015 |
| EP | 1676787 | A1 | 7/2006 |

JOINTED PACKAGE CORNER PROTECTOR

BACKGROUND OF THE INVENTION

1. Field of the Invention

The present invention relates to the field of display device packaging, and more particular to a light-emitting diode (LED).

2. The Related Arts

In the field of display technology, flat panel displays, such as liquid crystal displays (LCDs) and organic light emitting diode (OLED) displays, increasingly take the place of cathode ray tube (CRT) displays.

LCD is generally made up of a liquid crystal display panel and a backlight module. The liquid crystal display panel is formed of lamination of a thin film transistor (TFT) array substrate and a color filter (CF) substrate with liquid crystal filled between the TFT substrate and the CF substrate. Application of electricity would control molecules of the liquid crystal to change direction so as to refract out light emitting from the backlight module to generate an image.

OLED possesses numerous advantages, such as self-luminescence, low drive voltage, high lighting efficiency, short response time, high definition and contrast, almost 180° view angle, wide temperature range of applications, and capabilities of flexible displaying and large areas full-color displaying, and is considered in the industry the display device having the most prosperous future development.

Various specifications are currently available in the market for the sizes of LCD and OLED, such as smart mobile phones, tablet computers, notebook computers, and televisions. Accordingly, there are also various specifications of packages and consequently, the specifications of heights of cardboard boxes that are used to pack these displays and those for heights of stacking vary. During packing of display devices, it is commonplace to provide package corner protectors on four vertical edges of a stack of cardboard boxes for protection against impact and collision in order to protect the display devices contained in the cardboard boxes.

As shown in FIG. 1, a conventional package corner protector 100 is generally an integrally-formed elongate strip having an L-shaped cross-section. With additional reference to FIGS. 2 and 3, the package corner protectors 100 are first placed on the four vertical edges of a stack 200 of cartons and then a top-side lid 300 is set, followed by wrapping packing bands 400, to complete the packaging process.

Since there are plenty of models and specifications available for the contemporary display devices, the package specifications are of a huge number. Specifications for cardboard box heights and stack heights are variable significantly. Consequently, the integrally-formed one-piece package corner protectors 100 used in packaging need to have different lengths, and thus, it becomes necessary to design package corner protectors of multiple lengths to suit various packaging specifications. This is not economic and also causes troubles for parts-in and parts-out operations, eventually affecting manufacturing efficiency.

SUMMARY OF THE INVENTION

An objective of the present invention is to provide a jointed package corner protector, which allows easy variation of a length of the package corner protector to accommodate stacked heights of different package specifications of display devices, and is economic and practical and may help improve manufacturing efficiency.

To achieve the above objective, the present invention provides a jointed package corner protector, which comprises a plurality of corner plates and a connection assembly that connects two adjacent ones of the corner plates that are respectively set at upper and lower sides in a lengthwise direction of the corner plates;

wherein each of the corner plates is formed, in each of two opposite, upper and lower, ends thereof, with first through holes that are substantially perpendicular to the lengthwise direction of the corner plates; the connection assembly comprises a joint sheath and a button fastener; and the joint sheath is formed with second through holes that correspond to the first through holes formed in an upper end portion of a lower one of the two adjacent corner plates that is located at the lower side and the first through holes formed in a lower end portion of an upper one of the two adjacent corner plates that is located at the upper side such that the button fastener is set to penetrate through corresponding ones of the first through holes and the second through holes to connect the two adjacent corner plates of the upper and lower sides to the joint sheath.

The joint sheath has a cross-sectional shape that corresponds to and mates with a cross-sectional shape of the corner plates, and the cross-section of the corner plates is an L-shape.

The corner plates each comprise a first vertical board extending in the lengthwise direction thereof and a second vertical board extending in the lengthwise direction of the corner plate and substantially perpendicular to the first vertical board, opposite upper and lower ends of the first vertical board and opposite upper and lower ends of the second vertical board being each formed with the first through holes.

The upper and lower ends of the first vertical board and the upper and lower ends of the second vertical board are each formed with two first through holes.

The joint sheath comprises a first connection board mateable with the first vertical board and a second connection board mateable with the second vertical board; and the first connection board is formed with four second through holes and the second connection board is formed with four second through holes.

The joint sheath further comprises a third connection board corresponding to and opposite to the first connection board, a fourth connection board corresponding to and opposite to the second connection board, a first closure board connected between the first connection board and the third connection board, and a second closure board connected between the second connection board and the fourth connection board; the four second through holes formed in the first connection board are extended to penetrate through the third connection board, and the four second through holes formed in the second connection board are extended to penetrate through the fourth connection board; and the first connection board, the first closure board, the third connection board, the fourth connection board, the second closure board, and the second connection board collectively define an enclosure space, such that the two adjacent corner plates of the upper and lower sides have connectable portions that are respectively inserted into the enclosure space.

The first through holes and the second through holes are circular holes.

The button fastener comprises a base board and button bodies perpendicularly connected to the base board; and the button bodies have distal ends that are distant from the base board and are expanded relative to other portions thereof.

Optionally, two button bodies commonly share one base board.

The joint sheath and the button fastener are made of materials comprising plastics or corrugated paper.

The present invention also provides a jointed package corner protector, which comprises a plurality of corner plates and a connection assembly that connects two adjacent ones of the corner plates that are respectively set at upper and lower sides in a lengthwise direction of the corner plates;

wherein each of the corner plates is formed, in each of two opposite, upper and lower, ends thereof, with first through holes that are substantially perpendicular to the lengthwise direction of the corner plates; the connection assembly comprises a joint sheath and a button fastener; and the joint sheath is formed with second through holes that correspond to the first through holes formed in an upper end portion of a lower one of the two adjacent corner plates that is located at the lower side and the first through holes formed in a lower end portion of an upper one of the two adjacent corner plates that is located at the upper side such that the button fastener is set to penetrate through corresponding ones of the first through holes and the second through holes to connect the two adjacent corner plates of the upper and lower sides to the joint sheath;

wherein the first through holes and the second through holes are circular holes; and wherein the button fastener comprises a base board and button bodies perpendicularly connected to the base board; and the button bodies have distal ends that are distant from the base board and are expanded relative to other portions thereof.

The efficacy of the present invention is that the present invention provides a jointed package corner protector, which comprises corner plates each of which is formed, in two opposite, upper and lower, ends thereof, with first through holes that are perpendicular to a lengthwise direction of the corner plate and a joint sheath that is formed with second through holes that correspond to the first through holes formed in an upper end of a lower-side corner plate of two corner plates that are arranged adjacent to each other as being respectively set at upper and lower sides and the first through holes formed in a lower end of the upper-side corner plate, so that button fasteners may be set to penetrate through corresponding ones of the first through holes and the second through holes to connect the two adjacent corner plates of the upper and lower sides to the joint sheath, whereby easy variation of a length of the package corner protector can be achieved accommodate stacked heights of different package specifications of display devices so as to be economic and practical and help improve manufacturing efficiency.

BRIEF DESCRIPTION OF THE DRAWINGS

For better understanding of the features and technical contents of the present invention, reference will be made to the following detailed description of the present invention and the attached drawings. However, the drawings are provided only for reference and illustration and are not intended to limit the present invention.

In the drawings.

DETAILED DESCRIPTION OF THE PREFERRED EMBODIMENTS

To further expound the technical solution adopted in the present invention and the advantages thereof, a detailed description will be given with reference to the preferred embodiments of the present invention and the drawings thereof.

Figure 1:
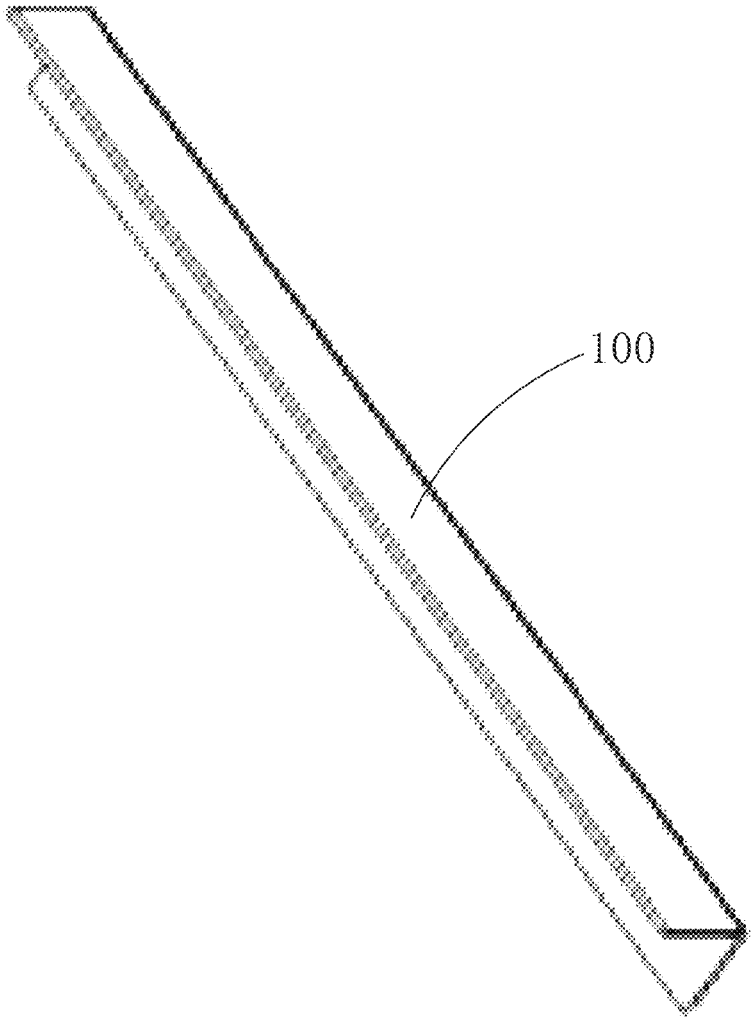
FIG. 1 is a perspective view illustrating a conventional integrally-formed one-piece package corner protector.
Figure 2:
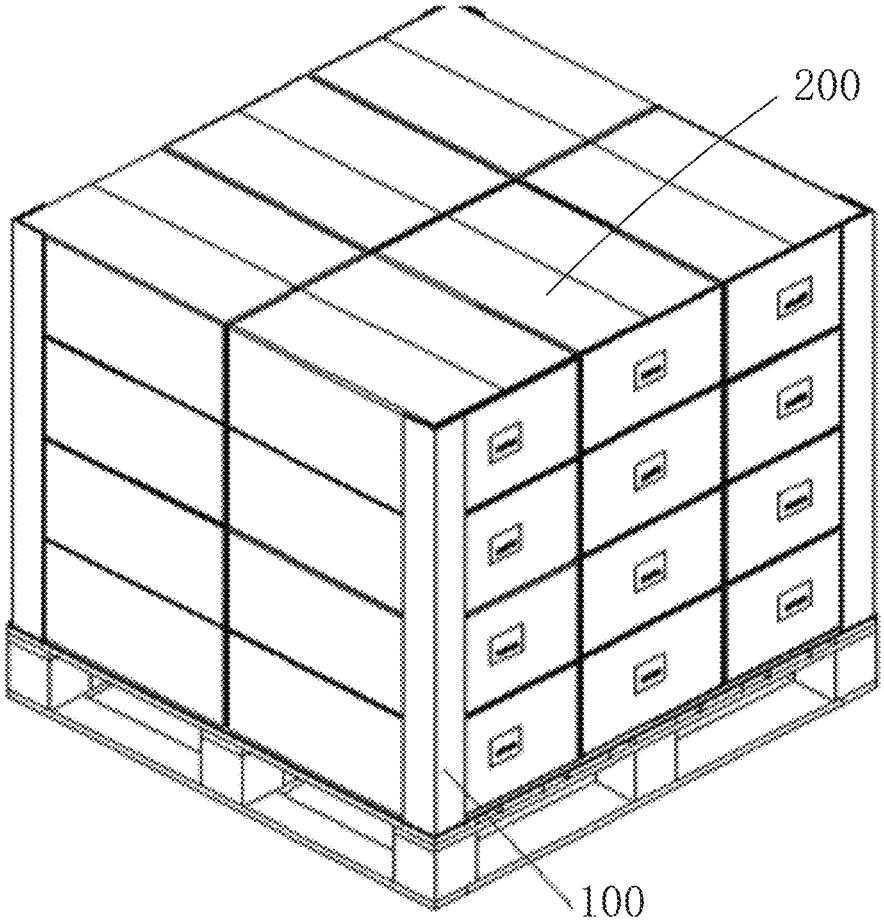
FIGS. 2 and 3 are schematic views demonstrating a packaging process conducted with the conventional integrally-formed one-piece package corner protectors.
Figure 3:
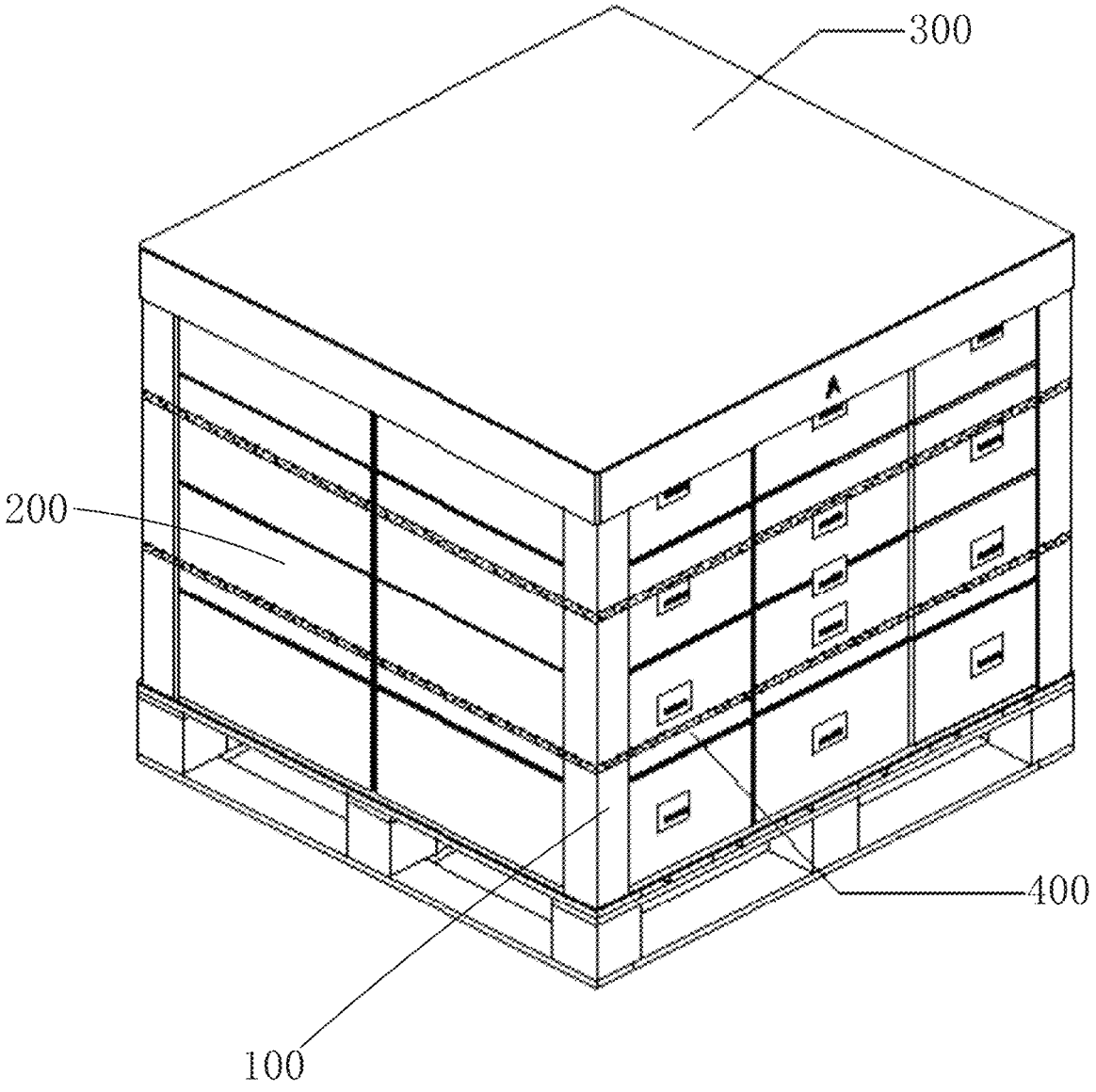
Figure 4:
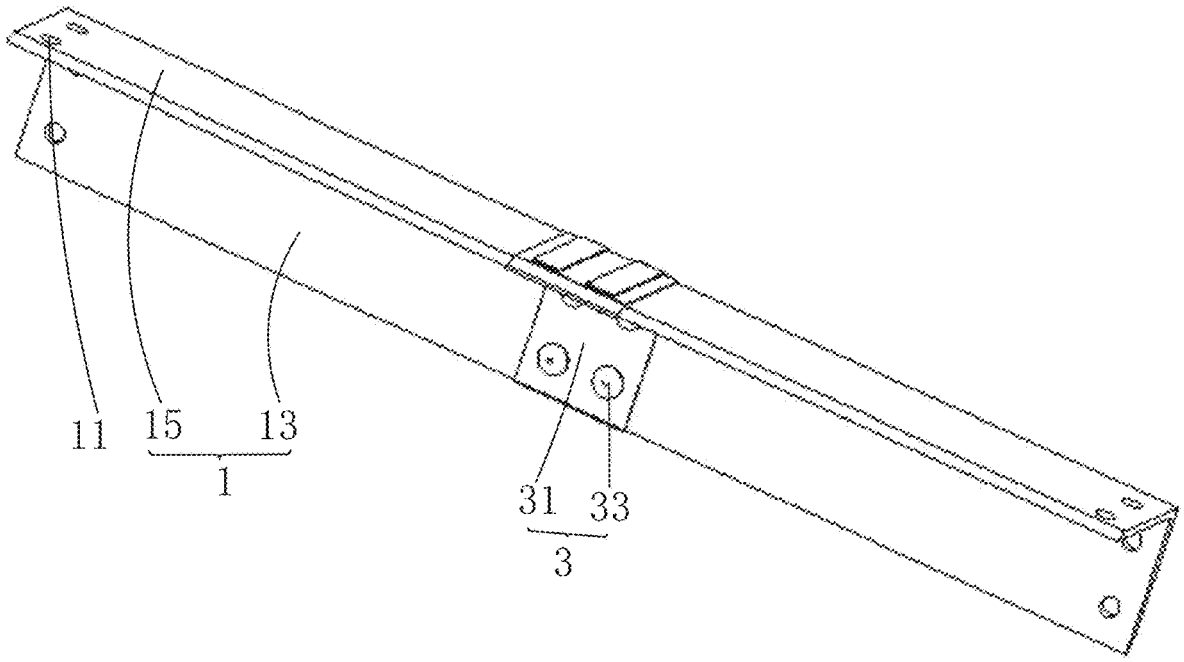
FIG. 4 is a perspective view illustrating a jointed package corner protector according to the present invention in an assembled form.
Figure 5:
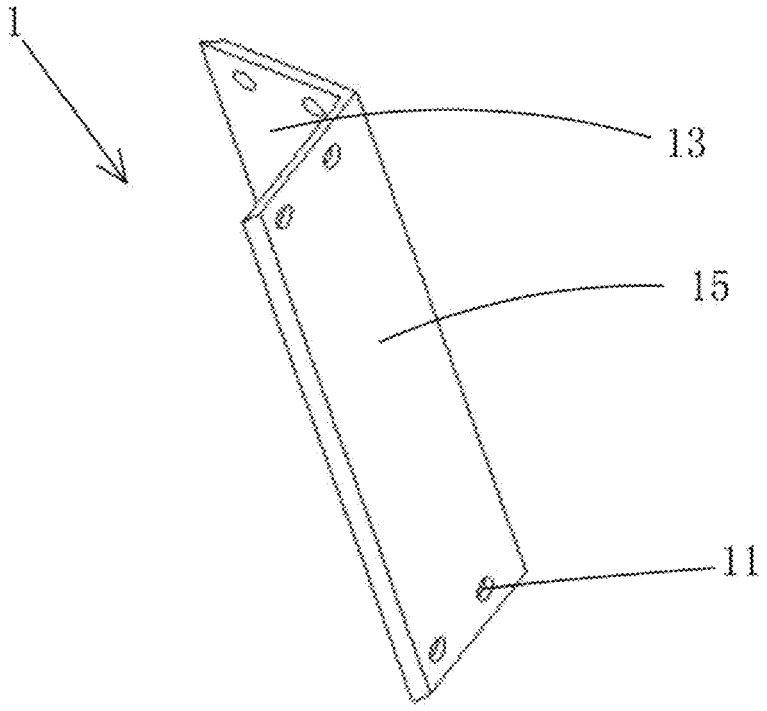
FIG. 5 is a perspective view showing a corner plate of the jointed package corner protector according to the present invention.

Referring to FIG. 4, the present invention provides a jointed package corner protector, which comprises a plurality of corner plates 1 and a connection assembly 3 that connects two of the corner plates 1 that are arranged adjacent to each other, respective at upper and lower sides, in a lengthwise direction of the corner plates 1. For stacked heights of different package specifications of display devices, the jointed package corner protector may be selected to involve different numbers of corner plates 1, among which connection is made with a corresponding number of connection assemblies 3, so that variation of length can be easily made to accommodate stacked heights of different package specifications.

Collectively referring to FIGS. 4, 5, 8, and 9, differences of the present invention from the prior art are that, first, each of the corner plates 1 is formed, in each of two opposite, upper and lower, ends thereof, with first through holes 11 that are substantially perpendicular to the lengthwise direction of the corner plates 1. Specifically, the corner plates 1 have a cross-section having an L-shaped configuration that comprises a first vertical board 13 extending in the lengthwise direction thereof and a second vertical board 15 extending in the lengthwise direction thereof and is substantially perpendicular to the first vertical board 13. The two ends of the first vertical board 13, respectively corresponding to upper and lower terminals, and the two ends of the second vertical board 15, respectively corresponding to upper and lower terminals thereof, are preferably each provided with two first through holes 11, but not limited thereto.

Collectively referring to FIGS. 4, 6, 7, 9, and 10, the differences of the present invention from the prior art also reside in the additional arrangement of the connection assembly 3. The connection assembly 3 comprises a joint sheath 31 and a button fastener 33. The joint sheath 31, which corresponds to two corner plates 11 that are arranged adjacent to each other, respectively at upper and lower sides, is formed with second through holes 311 respectively corresponding to the first through holes 11 formed in the upper end of the lower-side corner plate 1 of and the first through holes 11 formed in the lower end of the upper-side corner plate 1. The button fastener 33 is set to penetrate through the first through holes 11 and the second through holes 311 that correspond to each other to connect the two corner plates 1 that are adjacent to each other as being set at the upper and lower sides and the joint sheath 31 to each other. Preferably, the first through holes 11 and the second through holes 311 are both circular holes.

Specifically, the joint sheath 31 has a cross-sectional shape that corresponds to and mates with the cross-sectional shape of the corner plates 1. Further, the joint sheath 31 comprises at least a first connection board 313 that is matingly engageable with the first vertical board 13 and a second connection board 315 that is matingly engageable with the second vertical board 15. The first connection board 313 and the second connection board 315 are connected in a manner of being perpendicular to each other. The first connection board 313 is preferably formed with, but not limited to, four second through holes 311, and the second connection board 315 is preferably formed with, but not limited to, four second through holes 311.

Figure 7:
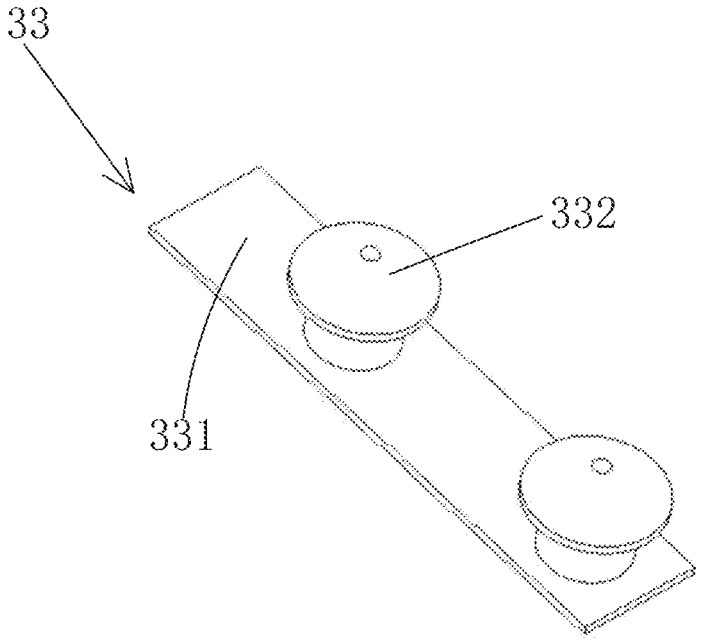
FIG. 7 is a perspective view showing a button fastener of the jointed package corner protector according to the present invention.
Figure 8:
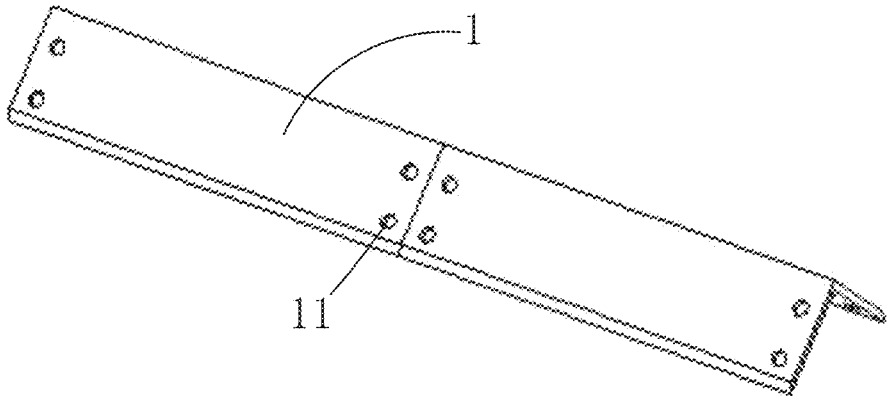
FIG. 8 is a perspective view showing two corner plates of the jointed package corner protector arranged adjacent to each other and respectively at upper and lower sides according to the present invention.
Figure 9:
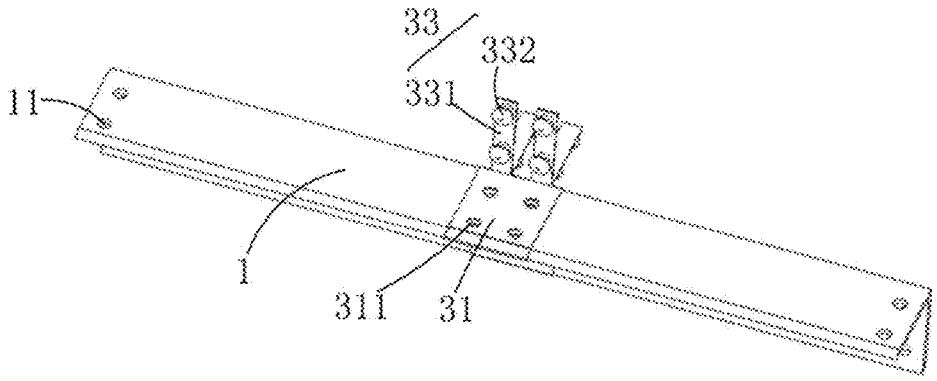
FIG. 9 is a perspective view showing the two corner plates of the jointed package corner protector that are arranged adjacent to each other respectively at upper and lower sides and are inserted into the joint sheath according to the present invention.

As shown in FIG. 7, the button fastener 33 comprises a base board 331 and button bodies 332 that are perpendicularly connected to the base board 331. The button bodies 332 each have a distal end that is distant from the base board 331 and is expanded and bulged relative to other portion. In consideration of ease of production and installation, two button bodies 332 are arranged to share one common base board 331.

In a case wherein the joint sheath 31 comprises only the first connection board 313 and the second connection board 315, the joint sheath 31 is set to directly contact portions of two corner plates 1 that are arranged adjacent to each other as being respectively set at upper and lower sides that are to be connected so that the first connection board 313 is in contact engagement with the first vertical board 13 and the second connection board 315 is in contact engagement with the second vertical board 15, and further, the second through holes 311 are respectively in alignment with the first through holes 11. Afterwards, the button fastener 33 is set through the first through holes 11 and the second through holes 311 that are set in alignment with to each other to allow connection of the two adjacent, upper and lower, corner plates 1 with the joint sheath 31. Further, two button fasteners 33 are set such that the base boards 331 are in abutting engagement with the first connection board 313 and the distal ends of the button bodies 332 are in abutting engagement with the first vertical board 13; and another two button fasteners 33 are set such that the base boards 331 are in abutting engagement with the second connection board 315 and the distal ends of the button bodies 332 are in abutting engagement with the second vertical board 15.

Figure 6:
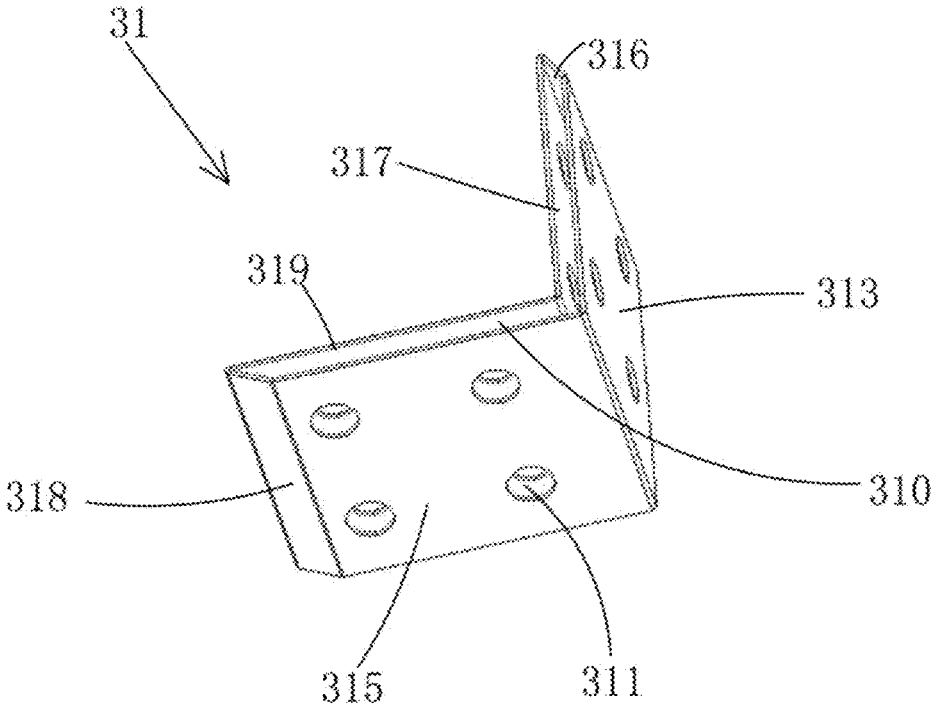
FIG. 6 is a perspective view showing a joint sheath of the jointed package corner protector according to the present invention.
Figure 10:
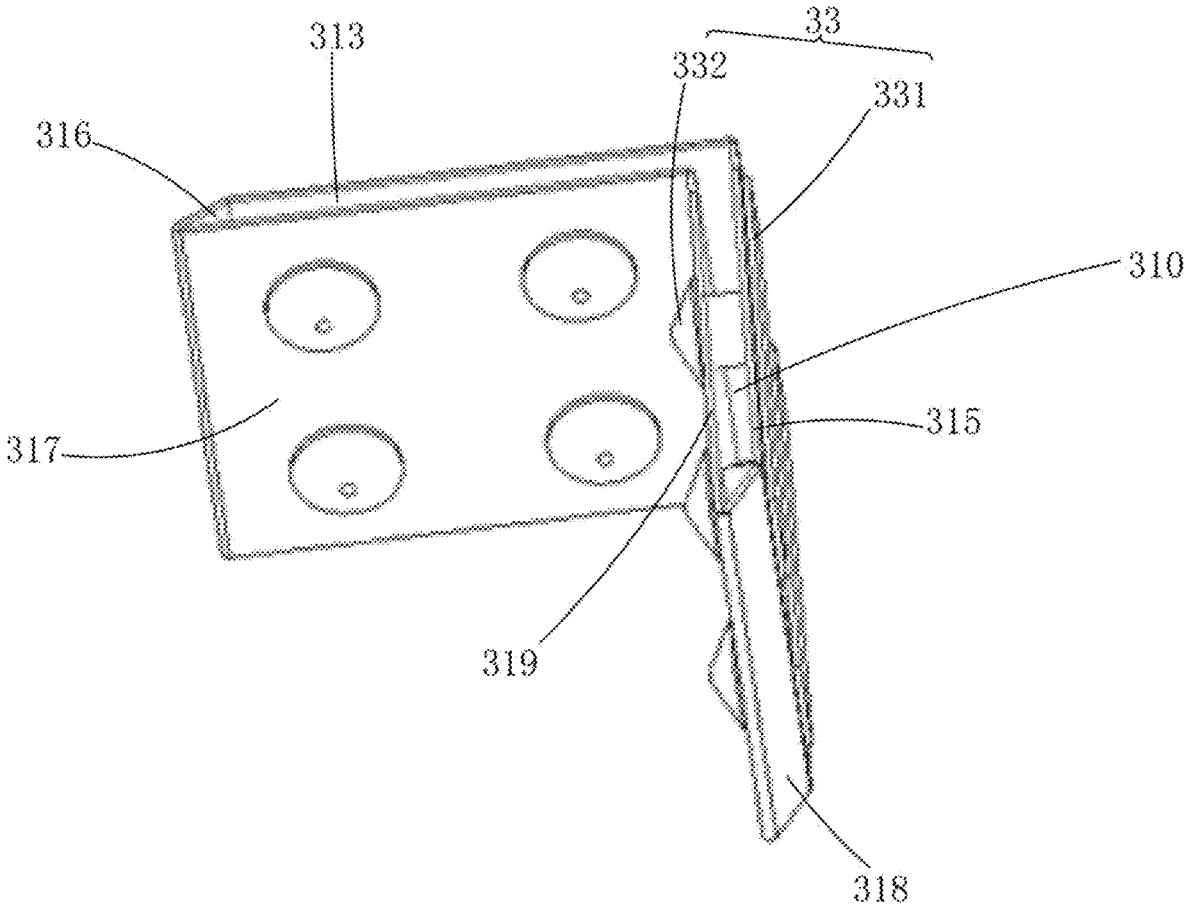
FIG. 10 is a perspective view illustrating combination of the button fastener and the joint sheath of the jointed package corner protector according to the present invention.

To improve security of connection, as shown in FIGS. 6 and 10, the joint sheath 31 may further comprise a third connection board 317 that corresponds to and in opposite to the first connection board 313, and a fourth connection board 319 that corresponds to and is opposite to the second connection board 315 and is perpendicularly connected to the third connection board 317, a first closure board 316 that connects between the first connection board 313 and the third connection board 317, and a second closure board 318 that connects between the second connection board 315 and the fourth connection board 319, wherein the four second through holes 311 that are formed in the first connection board 313 are extended to penetrate through the third connection board 317, and the four second through holes 311 that are formed in the second connection board 315 are extended to penetrate through the fourth connection board 319. The first connection board 313, the first closure board 316, the third connection board 317, the fourth connection board 319, the second closure board 318, and the second connection board 315 collectively define an enclosure space 310. Collectively referring to FIGS. 4, 6, 8, 9, and 10, in such a case, the portions of two adjacent, upper and lower, corner plates 1 that are to be connected are respectively inserted into the enclosure space 310 to have the first vertical board 13 located between the first connection board 313 and the third connection board 317 and the second vertical board 15 between the second connection board 315 and the fourth connection board 319 and the second through holes 311 in alignment with the first through holes 11; and then, the button fasteners 33 are set through corresponding ones of the first through holes 11 and the second through holes 311 to connect the two adjacent, upper and lower, corner plates 1 to the joint sheath 31. Further, two of the button fasteners 33 are set such that the base boards 331 are in abutting engagement with the first connection board 313 and the distal ends of the button bodies 332 are in abutting engagement with the third connection board 317; and another two fo the button fasteners 33 are set such that the base boards 331 are in abutting engagement with the second connection board 3 of and the distal ends of the button bodies 332 are in abutting engagement with the fourth connection board 319.

Specifically, the joint sheath 31 and the button fastener 33 may be both made of plastics through injection molding, or may alternatively be made of corrugated paper.

In summary, the present invention provides a jointed package corner protector, which comprises corner plates each of which is formed, in two opposite, upper and lower, ends thereof, with first through holes that are perpendicular to a lengthwise direction of the corner plate and a joint sheath that is formed with second through holes that correspond to the first through holes formed in an upper end of a lower-side corner plate of two corner plates that are arranged adjacent to each other as being respectively set at upper and lower sides and the first through holes formed in a lower end of the upper-side corner plate, so that button fasteners may be set to penetrate through corresponding ones of the first through holes and the second through holes to connect the two adjacent corner plates of the upper and lower sides to the joint sheath, whereby easy variation of a length of the package corner protector can be achieved accommodate stacked heights of different package specifications of display devices so as to be economic and practical and help improve manufacturing efficiency.

Based on the description given above, those having ordinary skills in the art may easily contemplate various changes and modifications of the technical solution and the technical ideas of the present invention. All these changes and modifications are considered belonging to the protection scope of the present invention as defined in the appended claims.

What is claimed is:

1. A jointed package corner protector, comprising a plurality of corner plates and a connection assembly that connects two adjacent ones of the corner plates that are respectively set at upper and lower sides in a lengthwise direction of the corner plates;

wherein each of the corner plates is formed, in each of two opposite, upper and lower, ends thereof, with first through holes that are substantially perpendicular to the lengthwise direction of the corner plates; the connection assembly comprises a joint sheath and a button fastener; and the joint sheath is formed with second through holes that correspond to the first through holes formed in an upper end portion of a lower one of the two adjacent corner plates that is located at the lower side and the first through holes formed in a lower end portion of an upper one of the two adjacent corner plates that is located at the upper side such that the button fastener is set to penetrate through corresponding ones of the first through holes and the second through holes to connect the two adjacent corner plates of the upper and lower sides to the joint sheath;

wherein the joint sheath has a cross-sectional shape that corresponds to and mates with a cross-sectional shape of the corner plates, and the cross-section of the corner plates is an L-shape;

wherein the corner plates each comprise a first vertical board extending in the lengthwise direction thereof and a second vertical board extending in the lengthwise direction of the corner plate and substantially perpendicular to the first vertical board, opposite upper and lower ends of the first vertical board and opposite upper and lower ends of the second vertical board being each formed with the first through holes;

wherein the upper and lower ends of the first vertical board and the upper and lower ends of the second vertical board are each formed with two first through holes;

wherein the joint sheath comprises a first connection board mateable with the first vertical board and a second connection board mateable with the second vertical board; and the first connection board is formed with four second through holes and the second connection board is formed with four second through holes;

wherein the joint sheath further comprises a third connection board corresponding to and opposite to the first connection board, a fourth connection board corresponding to and opposite to the second connection board, a first closure board connected between the first connection board and the third connection board, and a second closure board connected between the second connection board and the fourth connection board; the four second through holes formed in the first connection board are extended to penetrate through the third connection board, and the four second through holes formed in the second connection board are extended to penetrate through the fourth connection board; and the first connection board, the first closure board, the third connection board, the fourth connection board, the second closure board, and the second connection board collectively define an enclosure space, such that the two adjacent corner plates of the upper and lower sides have connectable portions that are respectively inserted into the enclosure space.

2. The jointed package corner protector as claimed in claim 1, wherein the first through holes and the second through holes are circular holes.

3. The jointed package corner protector as claimed in claim 1, wherein the button fastener comprises a base board and button bodies perpendicularly connected to the base board; and the button bodies have distal ends that are distant from the base board and are expanded relative to other portions thereof.

4. The jointed package corner protector as claimed in claim 3, wherein two button bodies commonly share one base board.

5. The jointed package corner protector as claimed in claim 1, wherein the joint sheath and the button fastener are made of materials comprising plastics or corrugated paper.

6. A jointed package corner protector, comprising a plurality of corner plates and a connection assembly that connects two adjacent ones of the corner plates that are respectively set at upper and lower sides in a lengthwise direction of the corner plates;

wherein each of the corner plates is formed, in each of two opposite, upper and lower, ends thereof, with first through holes that are substantially perpendicular to the lengthwise direction of the corner plates; the connection assembly comprises a joint sheath and a button fastener; and the joint sheath is formed with second through holes that correspond to the first through holes formed in an upper end portion of a lower one of the two adjacent corner plates that is located at the lower side and the first through holes formed in a lower end portion of an upper one of the two adjacent corner plates that is located at the upper side such that the button fastener is set to penetrate through corresponding ones of the first through holes and the second through holes to connect the two adjacent corner plates of the upper and lower sides to the joint sheath;

wherein the first through holes and the second through holes are circular holes; and wherein the button fastener comprises a base board and button bodies perpendicularly connected to the base board; and the button bodies have distal ends that are distant from the base board and are expanded relative to other portions thereof;

wherein the joint sheath has a cross-sectional shape that corresponds to and mates with a cross-sectional shape of the corner plates, and the cross-section of the corner plates is an L-shape;

wherein the corner plates each comprise a first vertical board extending in the lengthwise direction thereof and a second vertical board extending in the lengthwise direction of the corner plate and substantially perpendicular to the first vertical board, opposite upper and lower ends of the first vertical board and opposite upper and lower ends of the second vertical board being each formed with the first through holes;

wherein the upper and lower ends of the first vertical board and the upper and lower ends of the second vertical board are each formed with two first through holes;

wherein the joint sheath comprises a first connection board mateable with the first vertical board and a second connection board mateable with the second vertical board; and the first connection board is formed with four second through holes and the second connection board is formed with four second through holes;

wherein the joint sheath further comprises a third connection board corresponding to and opposite to the first connection board, a fourth connection board corresponding to and opposite to the second connection board, a first closure board connected between the first connection board and the third connection board, and a second closure board connected between the second connection board and the fourth connection board; the four second through holes formed in the first connection board are extended to penetrate through the third connection board, and the four second through holes formed in the second connection board are extended to penetrate through the fourth connection board; and the first connection board, the first closure board, the third connection board, the fourth connection board, the second closure board, and the second connection board collectively define an enclosure space, such that the two adjacent corner plates of the upper and lower sides have connectable portions that are respectively inserted into the enclosure space.

7. The jointed package corner protector as claimed in claim 6, wherein two button bodies commonly share one base board.

8. The jointed package corner protector as claimed in claim 6, wherein the joint sheath and the button fastener are made of materials comprising plastics or corrugated paper.

* * * * *